US007076896B2

(12) United States Patent
Villa

(10) Patent No.: US 7,076,896 B2
(45) Date of Patent: Jul. 18, 2006

(54) CONTROL FOR AN OPERATING ARM OF AN EARTHMOVING VEHICLE

(75) Inventor: Gabriele Villa, Turin (IT)

(73) Assignee: CNH America LLC, New Holland, PA (US)

( * ) Notice: Subject to any disclaimer, the term of this patent is extended or adjusted under 35 U.S.C. 154(b) by 232 days.

(21) Appl. No.: 10/384,316

(22) Filed: Mar. 6, 2003

(65) Prior Publication Data

US 2004/0153230 A1 Aug. 5, 2004

(30) Foreign Application Priority Data

Mar. 6, 2002 (IT) ..... TO2002A00186

(51) Int. Cl.
*E02F 3/64* (2006.01)
*F15B 11/10* (2006.01)

(52) U.S. Cl. ..... 37/414; 60/420

(58) Field of Classification Search ..... 172/2–11; 37/348, 382, 414, 902; 60/420, 444, 421, 60/445, 447, 464, 468, 422, 493, 426; 91/461, 91/364, 454; 701/50
See application file for complete search history.

(56) References Cited

U.S. PATENT DOCUMENTS 4,779,836 A * 10/1988 Marklund ..... 251/26
5,609,088 A * 3/1997 Park ..... 91/420
5,642,616 A * 7/1997 Park ..... 60/426
5,746,109 A 5/1998 Matsuda
5,816,351 A 10/1998 Akira et al.
6,038,957 A * 3/2000 Ertmann et al. ..... 91/461
6,050,090 A * 4/2000 Tohji ..... 60/421
6,173,513 B1 * 1/2001 Akimoto ..... 37/414
6,253,658 B1 7/2001 Kimura
6,282,890 B1 * 9/2001 Takano ..... 60/420
2001/0046433 A1 11/2001 Nishimura et al.
2002/0157529 A1 10/2002 Kariya et al.

FOREIGN PATENT DOCUMENTS

| | | |
|---|---|---|
| EP | 1264938 | 12/2002 |
| EP | 1 347 103 A2 | 9/2003 |
| EP | 1 347 103 A3 | 1/2004 |
| FR | 2487019 A | 10/1982 |
| JP | 02088825 A | 3/1990 |
| JP | 2000045339 A | 2/2000 |
| JP | 2001040713 A | 2/2001 |
| JP | 2001263305 A | 9/2001 |
| JP | 2001342648 A | 12/2001 |
| JP | 2002 294757 A | 10/2002 |
| WO | WO 0188382 A | 11/2001 |

* cited by examiner

*Primary Examiner*—Robert E. Pezzuto
(74) *Attorney, Agent, or Firm*—Stephen A. Bucchianeri; John William Stader; Michael C. Harms

(57) ABSTRACT

An earthmoving vehicle has an operating arm that is raised and lowered by a hydraulic system. The hydraulic system includes a drain line and at least one actuator connected to the operating arm. The actuator defines a variable-volume chamber connectable to the drain line to lower the operating arm. The hydraulic fluid discharged from the chamber flows through a proportional safety valve adjacent to the actuator and a distributor valve that is driven by a pilot control valve to allow free flow to the drain line. Thus, the lowering of the operating arm is controlled solely by the proportional safety valve.

6 Claims, 3 Drawing Sheets

CONTROL FOR AN OPERATING ARM OF AN EARTHMOVING VEHICLE

BACKGROUND OF THE INVENTION

The present invention relates to an operating arm on an earthmoving vehicle, and in particular to a control for an operating arm that is move up and down by a hydraulic system.

In an earthmoving vehicle such as an excavator, the operating arm links, such as the boom arm, are usually moved by a number of double-acting linear actuators.

Fluid flow to the actuators is controlled by a central hydraulic supply and control unit. Each actuator is associated with a proportional distributor valve, which is connected by hydraulic lines to the actuator chambers. The control unit regulates the hydraulic fluid pressure and the fluid flow to and from the actuator chambers during the operation of the arm, as for example in the digging mode.

However, the operating arm of these vehicles can also be used for moving loads over distances. Consequently, a regulating valve is provided in series between each actuator and the associated distributor valve to guard against loss of hydraulic fluid in the event of damage to the hydraulic lines or other fluid components. The regulating valve prevents the load from dropping when the operating arm descends rapidly.

The addition of a regulating valve, however, affects the response times when the arm is used in normal operations, such as in the digging mode. Traditionally the response times are calculated and set solely with reference to the distributor valve. However the distributor valve and regulating valve operate in contrast with each other during transient operating conditions.

SUMMARY OF THE INVENTION

It is therefore an object of the present invention to provide an earthmoving vehicle designed to provide a straightforward, low-cost solution to the above problem.

According to a first aspect of the present invention, there is provided an earthmoving vehicle having an operating arm movable between a raised position and a lowered position, and a fluid system for moving the operating arm between the raised position and the lowered position. The system includes a drain line for draining the fluid, at least one actuator connected to the operating arm and defining a variable-volume first chamber connectable to the drain line to lower the operating arm, and first and second control means interposed between the drain line and the first chamber. Each control means performs a relative first shift movement associated with lowering of the operating arm to drain the fluid from the first chamber. The second control means is located in series between the first control means and the first chamber. The first control means including a free flow opening permitting free flow of hydraulic fluid to the drain line during a shift of the first control means in the given direction.

According to a second aspect of the present invention, there is provided a method of regulating lowering of an operating arm of an earthmoving vehicle including a fluid system for moving the operating arm between a raised position and a lowered position. The system includes a drain line for draining the fluid, at least one actuator connected to the operating arm and defining a variable-volume chamber connectable to the drain line to lower the operating arm, and first and second control means interposed between the drain line and the chamber. The second control means is located in series between the first control means and the chamber The method further includes the step of controlling the first and second control means in a manner such that the first control means are controlled to allow free flow of the fluid to the drain line when lowering the operating arm, so that lowering the arm is controlled solely by the second control means.

BRIEF DESCRIPTION OF THE DRAWINGS

The advantages of the present invention will be apparent from the following detailed description, especially with reference to the accompanying drawings, wherein.

DETAILED DESCRIPTION OF THE PREFERRED EMBODIMENT

Figure 1:
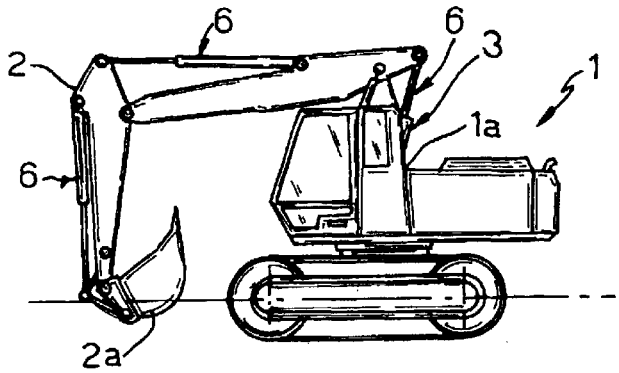
FIG. 1 shows a preferred, non-limiting embodiment of an earthmoving vehicle according to the present invention.

Referring to FIG. 1, an earthmoving vehicle 1, such as an excavator, has a supporting frame and body 1*a*. An operating arm 2 is supported on the frame and body. The operating arm is fitted at a distal end with a gripping or excavating tool 2*a*, such as for example a shovel or bucket. The operating arm 2 is articulated and is pivotally connected to the frame and body 1*a* at the proximal end. The operating arm 2 moves up and down between a first operating position (not shown) in which the excavating tool 2*a* is raised, and a second operating position in which the tool 2*a* is lowered.

Figure 2:
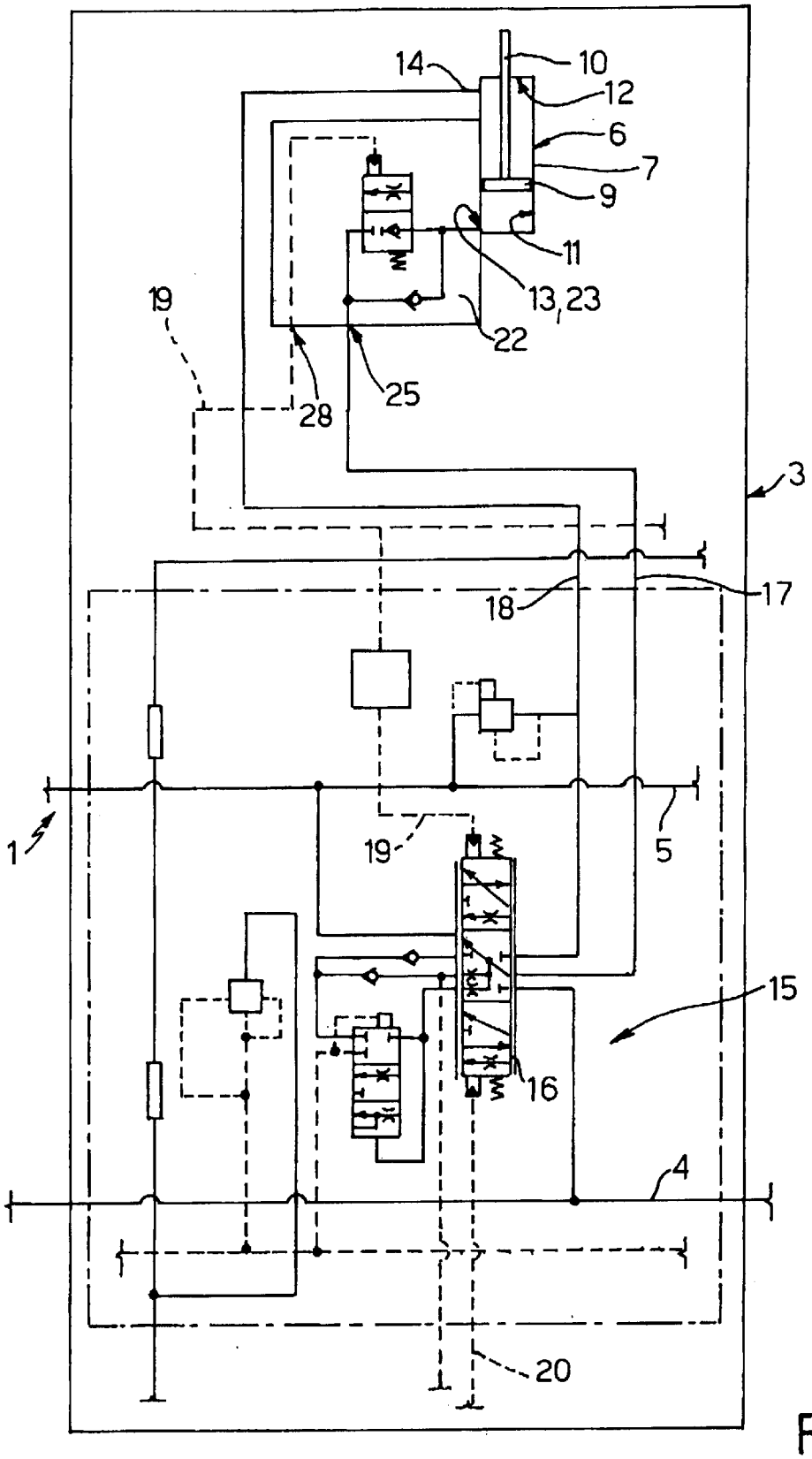
FIG. 2 shows a partial diagram of the hydraulic system according to the present invention for the earthmoving vehicle of FIG. 1.

With reference to FIG. 2, the vehicle 1 also includes a hydraulic system 3 (shown partly and schematically). The hydraulic system includes a hydraulic fluid supply line 4 communicating with a fluid source tank and a hydraulic pump (not shown). A hydraulic fluid drain line 5 is also connected to the source tank (not shown). A number of linear hydraulic actuators 6, such as hydraulic cylinders, are connected to arm 2 in a known manner to raise and lower arm 2 between the first and second operating positions.

In FIG. 2, only a single actuator 6 and the part of the hydraulic system 3 relating to that one actuator is shown. The same configuration described herein substantially applies to multiple actuators 6. For example, the actuator 6 that is partially hidden by the operator cab in FIG. 1 is the lift arm actuator. The lift arm actuator 6 is the primary actuator of the operating arm 2 and is operable to raise and lower the first portion of arm 2 which is directly connected to the supporting frame and body 1*a*.

Linear actuator 6 is preferably a double-acting hydraulic cylinder and includes a cylinder housing 7 and a reciprocating piston 9 that is connected to a piston rod 10. The piston 9 is movable inside cylinder housing 7 by the pressurised hydraulic fluid to move rod 10 between a withdrawn (or retracted) position and an extended position with respect to cylinder housing 7. The piston separates the hollow interior of the cylinder housing into two variable-volume chambers 11 and 12 in a fluid-tight manner. Chambers 11 and 12 each have a respective inlet/outlet port 13 and 14 formed in cylinder housing 7 to receive pressurised hydraulic fluid from the supply line 4 so as to raise and lower arm 2.

Also in FIG. 2, the hydraulic system 3 further includes a central hydraulic control unit 15 that is remotely positioned away from operating arm 2. The central control unit 15 includes a fluid distributor valve 16 associated with each actuator 6. Each distributor valve 16 is connected to ports 13 and 14 by respective hydraulic lines 17 and 18.

Distributor valve 16 is operated by two hydraulic pilot control lines 19 and 20 to shift the valve in two opposite directions from the central position of the valve. One shift direction is associated with lowering arm 2 and the other direction is associated with raising arm 2. Distributor valve 16 continuously regulates hydraulic fluid flow to and from chamber 12. Distributor valve 16 also selectively connects chamber 11 to supply line 4 when raising arm 2. Distributor valve 16 also connects chamber 11 to the drain line 5 when the arm 2 is in the idle condition and when the arm 2 is being lowered.

The construction and response time characteristics of valve 16 are such that it acts as a proportional or continuous-position valve with regard to hydraulic fluid flow to and from chamber 12 and to chamber 11. The valve 16 exerts no fluid flow control and allows free passage of hydraulic fluid flow from chamber 11 when the arm 2 is being lowered or when the arm is in the idle position.

Figure 4:
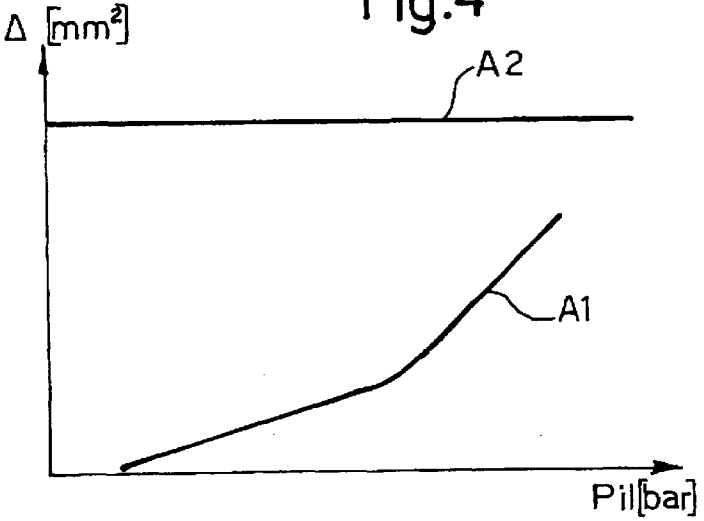
FIG. 4 shows a graph of an operating characteristic of the hydraulic system of FIG. 2.

With reference to both FIGS. 2 and 4, when the valve 16 is shifted from the central position, the valve has a constant flow cross section for the fluid draining from chamber 11 along return line 17. Hydraulic fluid flow from chamber 11 is regulated continuously by a regulating valve 22, such as a proportional or continuous-position shuttle or slide valve.

Regulating valve 22 forms part of the hydraulic system 3 and is located in fluid flow series with distributor valve 16, at the end of hydraulic line 17 and adjacent to chamber 11. Preferably valve 22 is positioned adjacent actuator 6 so as to eliminate ordinary connecting lines, which can be damaged, between hydraulic actuator 6 and valve 22. More preferably, valve 22 is positioned with an inlet/outlet port 23 connected directly to housing 7 and, therefore, coincident with port 13.

Figure 6:
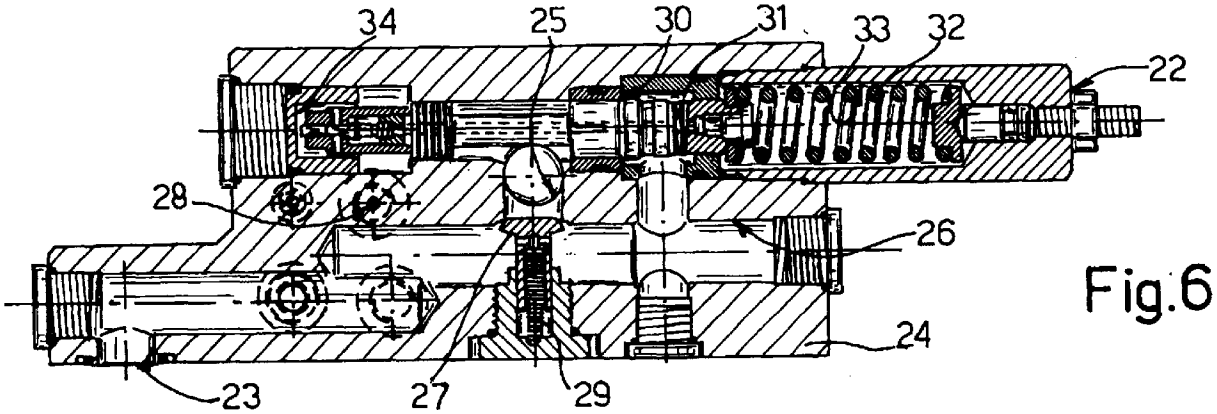
FIG. 6 shows a cross section of the regulating valve of the hydraulic system in FIG. 2.

FIG. 6 shows a preferred embodiment of regulating valve 22, which includes a body 24 defining an inner cavity 26. The body includes the previously described first inlet/outlet port 23 and a second inlet/outlet port 25 connected to line 17. The inner cavity 26 connects ports 23 and 25 and houses a movable shutter member 27. Shutter member 27 is acted on by a spring 29 to define a non-return or one-way valve that allows hydraulic fluid to only flow through port 25 to port 23 and into chamber 11 to raise operating arm 2. The shutter member prevents hydraulic fluid flow in the opposite direction.

Hydraulic fluid flows from port 23 to port 25 through a passage 30. The cross-section size of the passage is determined by the position of shuttle member 31 in the passage. In FIG. 6, the cross-section size of the passage 30 is zero. The position of the shuttle 31 is determined by the opposing actions of a preloaded spring 32 and by a hydraulic pilot pressure or drive signal. The drive signal is supplied by fluid pressure in a control line 19 (FIG. 2). The drive signal is indicated as "Pil" along the x-axis in the graph in FIG. 4. The drive signal is supplied by the pilot control line 19 to an inlet 28 formed in valve body 24.

More specifically, shuttle member 31 separates the inner cavity 26 into two chambers 33 and 34. Chamber 33 contains a spring 32 and communicates with the drain tank (not shown) in a known manner. Chamber 34 is in fluid communication with inlet 28, so that as the pilot pressure increases, shuttle member 31 slides to the right in FIG. 6 to compress spring 32. The cross section size or opening of passage 30 is thereby gradually increased.

The fluid pressure in pilot control line 19 is generated when the vehicle operator manipulates levers or a joystick (not shown) in the cab to lower the arm 2. The fluid pressure in pilot control line 19 is proportional to the stroke or movement of the levers or joystick. Thus, the more the levers or joystick are moved, the more the pilot pressure in line 19 will increase and thus the more regulating valve 22 will be opened.

The graph in FIG. 4 shows a curve A1 indicating the cross sectional size of passage 30 in regulating valve 22 as a function of the fluid pressure supplied by pilot control line 19. The pilot control line pressure is indicated as "Pil" along the x-axis. A curve A2 indicates the flow section of valve 16 as a function of the drive signal provided by line 19 for the fluid drained by return line 17 and drain line 5. The flow section or flow size of valve 16 from return line 17 to drain line 5 is constant and larger than the cross section size of passage 30 during shift movement of valve 16 so as to lower operating arm 2. The flow section is constant and larger for each value of the pilot pressure controlling both valves 16 and 22 when arm 2 is lowered. Thus the fluid discharged from chamber 11, and therefore the lowering of arm 2, is controlled solely by regulating valve 22 in the present invention. The bend in curve A1 is a result of the specific shape of shuttle member 31 and the flow area through passage 30. Thus the initial hydraulic fluid flow through regulating valve 22 is initially reduced and only increases after the lever or joystick has moved a predetermined distance. This feature improves operator control and precision when only small movements of the arm 2 are needed.

Figure 3:
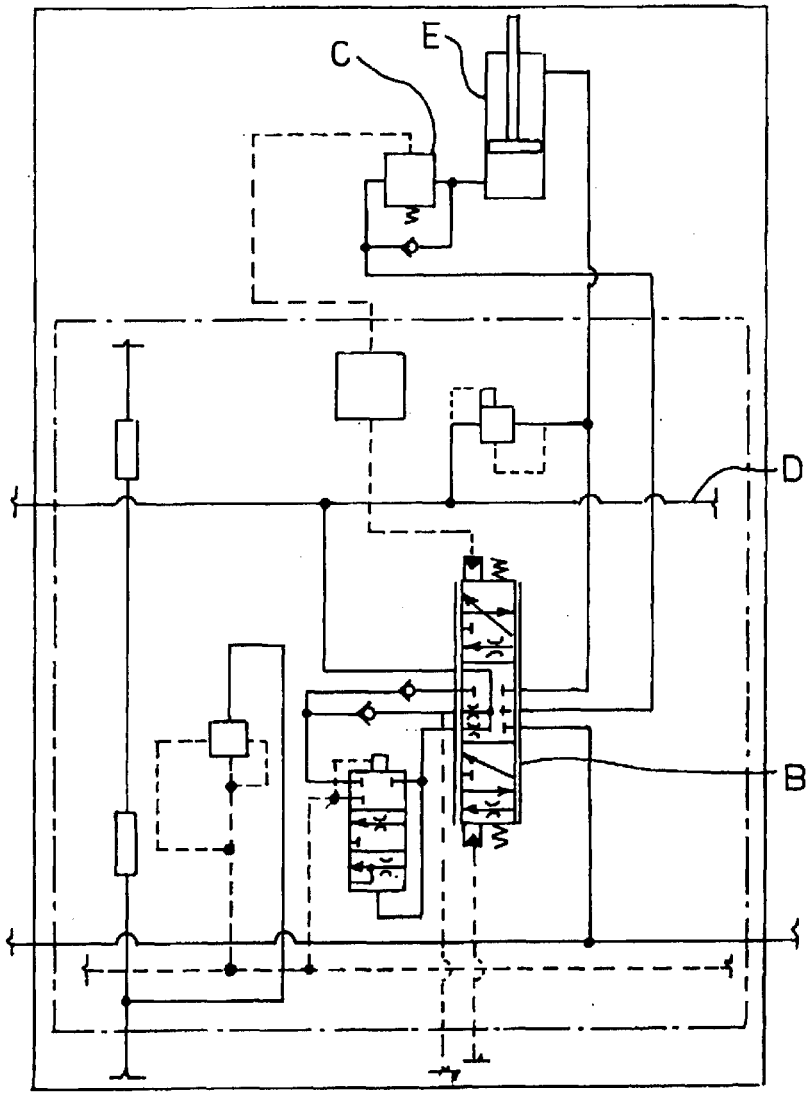
FIG. 3 is a diagram similar to FIG. 2 and shows a known hydraulic system for an earthmoving vehicle.
Figure 5:
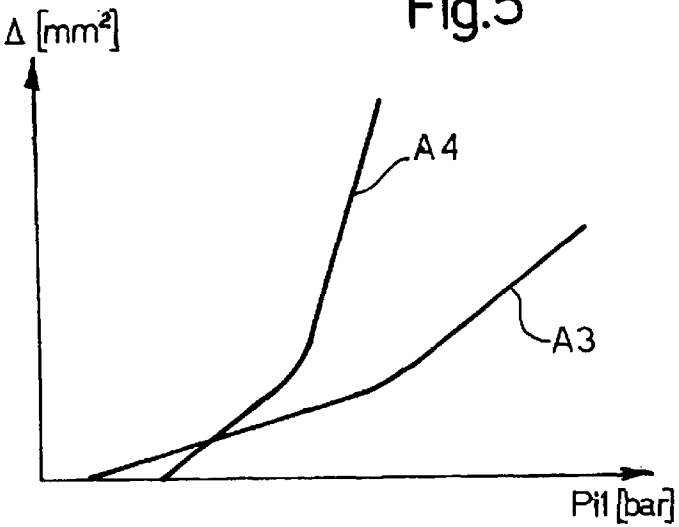
FIG. 5 is a graph similar to FIG. 4 and shows the operating characteristic of the known hydraulic system of FIG. 3.

In known hydraulic systems, as shown in FIG. 3, when the operating arm of the vehicle is lowered, the fluid flow is controlled by a distributor valve B and a safety valve C (not shown in detail). The valves B and C are positioned in series between drain line D and actuator E, and operate as shown in the graph in FIG. 5. More specifically, when the operating arm 2 is lowered, valves B and C are controlled by a drive signal (indicated "Pil" along the x-axis). The valves B and C have respective drain sections indicated by respective curves A3 and A4, which both vary as a function of the drive signal (Pil). Curves A3 and A4 intersect each other so that, as known in the art, both valves B and C partially control the hydraulic fluid flow drained to cause the operating arm 2 to be lowered. More specifically, along a first regulating portion, curve A4 is lower than curve A3. Thus the lowering of the arm 2 is substantially controlled by safety valve C, as required by ISO standard 8643 governing the safe lowering speed of the operating arm. (ISO standard 8643 governs safe lowering of the lift arm in the event of damage to the hydraulic lines or components.) Along a second regulating portion, curve A3 is lower than curve A4, so that the lowering of the arm is substantially controlled by distributor valve B.

In contrast, in the present invention, hydraulic fluid flow from chamber 11 is regulated solely by regulating valve 22, while distributing valve 16 has no control over hydraulic fluid flow from chamber 11.

Activation of distributing valve 16 therefore has little effect on the response times of valve 22. Thus hydraulic system 3 can be set for normal operation of arm 2 without flow control when arm 2 is lowered during transition between operating positions because the two valves 16 and 22 are in series.

Moreover, in addition to regulating flow from chamber 11, regulating valve 22 also provides another advantage. Because valve 22 is located adjacent to actuator 6, valve 22 promptly disables the lowering of arm 2, particularly in the event of damage to line 17.

As shown in FIG. 2, port 13 can be closed by valve 22 to prevent hydraulic fluid from being discharged from chamber 11 and thus prevent the unintended lowering of arm 2 and the dropping of the load being carried by arm 2. This feature is particularly useful in situations involving damage to line 17, in which situation the valve 22 is closed to immediately prevent hydraulic fluid discharge from chamber 11, and thus also control the lowering of arm 2 to the ground.

Other embodiments of the hydraulic system 3 may be apparent from the embodiment as described and illustrated herein without departing from the scope of the present invention.

In particular, distributor valve 16 may be replaced by two separate, independently controlled valves. A first proportional valve is provided for regulating hydraulic fluid flow to and from chamber 12. A second valve is provided for proportionally regulating hydraulic fluid flow to chamber 11, and continuously connecting return line 17 to drain line 5.

It is also understood that although the regulating valve 22 has been described as associated with the piston side (i.e. chamber 11) of cylinder 6, the regulating valve 22 could also be associated with the rod side (chamber 12). For example, this would occur in operating situations when the lowering of an operating arm would result in the draining of fluid from chamber 12. For example, this configuration is shown for the uppermost cylinder 6 in FIG. 1, which controls the dipper arm link.

What is claimed is:

1. A hydraulic system for an earthmoving vehicle having an operating arm movable between a raised position and a lowered position, the hydraulic system causing the operating arm to move between the raised position and the lowered position, the hydraulic system comprising:

at least one hydraulic atuator connected to the operating arm and defining a first variable-volume chamber;

a fluid drain line for draining hydraulic fluid from the first variable-volume chamber so as to lower the operating arm;

a first fluid flow control means positioned between the first chamber and the drain line, the first fluid flow control means being operable to shift in a first respective direction that is associated with lowering the operating arm so as to drain the fluid from the first chamber, the first control means having a free flow opening permitting free flow of fluid to the fluid drain line when the first control means is shifted in the first respective direction;

a second fluid flwo control means positioned in fluid flow series between the first control means and the first chamber, the second control means being operable to shift in a second respective direction that is associated with lowering the operating arm so as to drain the fluid from the first chamber, the second control means having a variable flow section;

a pilot pressure having a variable value for shifting the first and second control means in their respective directions; and the free flow opening of the first control means being larger than the flow section of the second control means for each variable value of the pilot pressure.

2. The hydraulic system according to claim 2 wherein the flow section of the first control means is constant for each variable value of the pilot pressure when the first control means is shifted in the first respective direction.

3. The hydraulic system according to claim 3 wherein the first control means comprises a regulating valve operable to perform a first shift in the respective direction and further operable to perform a second shift to proportionally regulate fluid flow to the first chamber.

4. The hydraulic system according to claim 4, wherein the actuator defines a second variable-volume chamber; and the regulating valve forming part of a distributor valve for proportionally regulating fluid flow to and from the second chamber.

5. The hydraulic system according to claim 5, wherein the second control means comprises a proportional valve having an inlet/outlet port coincident with a port of the first chamber.

6. A method of regulating the lowering of an operating arm of an earthmoving vehicle having a hydraulic system) for moving the operating arm between a raised position and a lowered position;

the system including a drain line for draining hydraulic fluid, at least one actuator connected to the operating arm and defining a variable-volume chamber connectable to the drain line to lower the operating arm, a first control means having a free flow opening permitting free flow of fluid to the drain line when the first control means is shifted in a first respective direction, and a second control means interposed between the drain line and the chamber, the second control means being located in series between the first control means and the chamber the second control having a variable flow section, a pilot pressure having a variable value for shifting the first and second control means in their respective directions, the free flow opening of the first control means being larger than the flow section of the second control means for each variable value of the pilot pressure;

the method comprising the step of controlling the first and second control means in a manner so that the first control means are controlled to allow free flow of the fluid to the drain line when lowering the operating arm, so that lowering is controlled solely by the second control means.

* * * * *